US006805089B2

(12) United States Patent
Kemper et al.

(10) Patent No.: US 6,805,089 B2
(45) Date of Patent: Oct. 19, 2004

(54) INTAKE DEVICE

(75) Inventors: Ralph Kemper, Kornwestheim (DE); Juergen Lang, Kornwestheim (DE); Thomas Schermuly, Rosengarten (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/324,107

(22) Filed: Dec. 20, 2002

(65) Prior Publication Data

US 2003/0140883 A1 Jul. 31, 2003

(30) Foreign Application Priority Data

Dec. 22, 2001 (DE) ..... 101 63 816

(51) Int. Cl.[7] ..... F02M 35/10
(52) U.S. Cl. ..... 123/184.61; 123/184.31
(58) Field of Search ..... 123/184.61, 184.31, 123/184.34

(56) References Cited

U.S. PATENT DOCUMENTS 4,805,564 A * 2/1989 Hudson, Jr. ..... 123/184.61
4,829,944 A * 5/1989 Sukimoto et al. ..... 123/184.61
5,005,532 A * 4/1991 Shillington ..... 123/184.61
5,211,139 A * 5/1993 Houle et al. ..... 123/184.61
6,499,473 B2 * 12/2002 Itoh ..... 123/184.61
6,581,560 B1 * 6/2003 Mammarella ..... 123/184.31
6,601,556 B2 * 8/2003 Nakano et al. ..... 123/184.61
6,604,500 B2 * 8/2003 Miyahara et al. ..... 123/184.61

FOREIGN PATENT DOCUMENTS

GB 2279035 12/1994

* cited by examiner

*Primary Examiner*—Henry C. Yuen
*Assistant Examiner*—Jason Benton
(74) *Attorney, Agent, or Firm*—Crowell & Moring LLP

(57) ABSTRACT

An intake device (1) for an internal combustion engine including a main body (2) and cover element (3; 20) which are securely connected to one another. Main body (2) and cover element (3) form intake pipes (4, 5, 6, 7) of in intake manifold. The cover element (3; 20) includes a plurality of individual shells (14, 15, 16, 17; 24, 25, 26, 27), which are connected to one another. Each individual shell (14, 15, 16, 17; 24, 25, 26, 27) forms a wall section of a respective intake pipe (4, 5, 6, 7) of the intake device (1). A flexible connection element (22) is arranged between two successively adjacent individual shells (25, 26) to compensate for tolerances between the cover element (3) and the main body (2).

11 Claims, 5 Drawing Sheets

INTAKE DEVICE

BACKGROUND OF THE INVENTION

The present invention relates to an air intake device for an internal combustion engine comprising a main body and a cover element which are securely joined to one another and which form at least two intake pipes.

British Patent no. GB 2,279,035 discloses an air intake device comprising a main body having a cover element placed thereon and attached thereto by friction welding. The cover element is formed by four partial shells of the intake manifold, which are rigidly connected to one another via a transverse section of the header pipe. In order to be able to compensate for tolerances between the main body and the cover element, the material of the cover element is more flexible than that of the main body. However, the use of a flexible material for the entire cover element leads to a lower compressive strength of the intake manifolds. In addition, the use of different materials for the cover element and the main body may lead to a lower strength of the friction weld bond.

SUMMARY OF THE INVENTION

It is an object of the present invention to provide an improved air intake device of the foregoing type.

Another object of the invention is to provide an air intake device having a main body and a cover element which can be joined to each other with great precision.

A further object of the invention is to provide an air intake device which avoids the need for parts constructed of different materials.

These and other objects have been achieved in accordance with the present invention by providing an intake device for an internal combustion engine comprising a main body and a cover element which are securely joined to one another and which form at least two intake pipes, in which the cover element comprises a plurality of individual shells connected to one another, each individual shell forming a wall section of an intake pipe of the intake device, and wherein the connection between at least two successively adjacent individual shells is formed by a flexible connection element arranged between them.

The arrangement of a flexible connecting element between neighboring individual shells allows the compensation of tolerances between the main body and the cover element, such as those which may occur through contraction during injection molding, for example. The individual shells of the cover element are connected to one another as in prior devices, so that the number of individual parts is not increased. The cover element and the main body may be made of the same material.

The connection element is advantageously flexible in all three spatial directions, so that tolerances may be compensated for in all directions. For this purpose, the connection element has a flexible section, which is particularly positioned centrally between two individual shells. The flexible section may, for example, be produced easily in the injection molding method and has elastic properties, through which the tolerances may be compensated. In order to achieve approximately constant stress ratios, the flexible section has an approximately constant width over its length. The flexible section may advantageously be constructed, for example, as V-shaped, horseshoe or omega-shaped, circular, elliptical, or zig-zag shaped. Other configurations may also be advantageous.

To facilitate the ability, of the cover to accept and withstand applied forces, additional sections, which are thicker the flexible section, are provided between the individual shells and the flexible section.

The cover element is advantageously manufactured in one piece. The main body and the cover element may be connected to one another by a material bond, in particular by a vibration-welded joint. For this purpose, the main body and the cover element advantageously contact each other through peripheral flanges which can be welded together.

The connection element advantageously extends essentially in the plane of the flange of the cover element. The connection element is preferably fixed on the flange. In order to achieve good elasticity of the connection element, the thickness of the connection element is less than the thickness of the flange. Particularly in intake devices for internal combustion engines having large piston displacements, it may be advantageous for the individual shells to be rigidly connected to one another at one end, via a section of a collecting chamber, for example, and for at least one flexible connection element to be arranged at their other ends. In order to compensate for larger tolerances, it is particularly advantageous to arrange a flexible connection element between each pair of individual shells.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
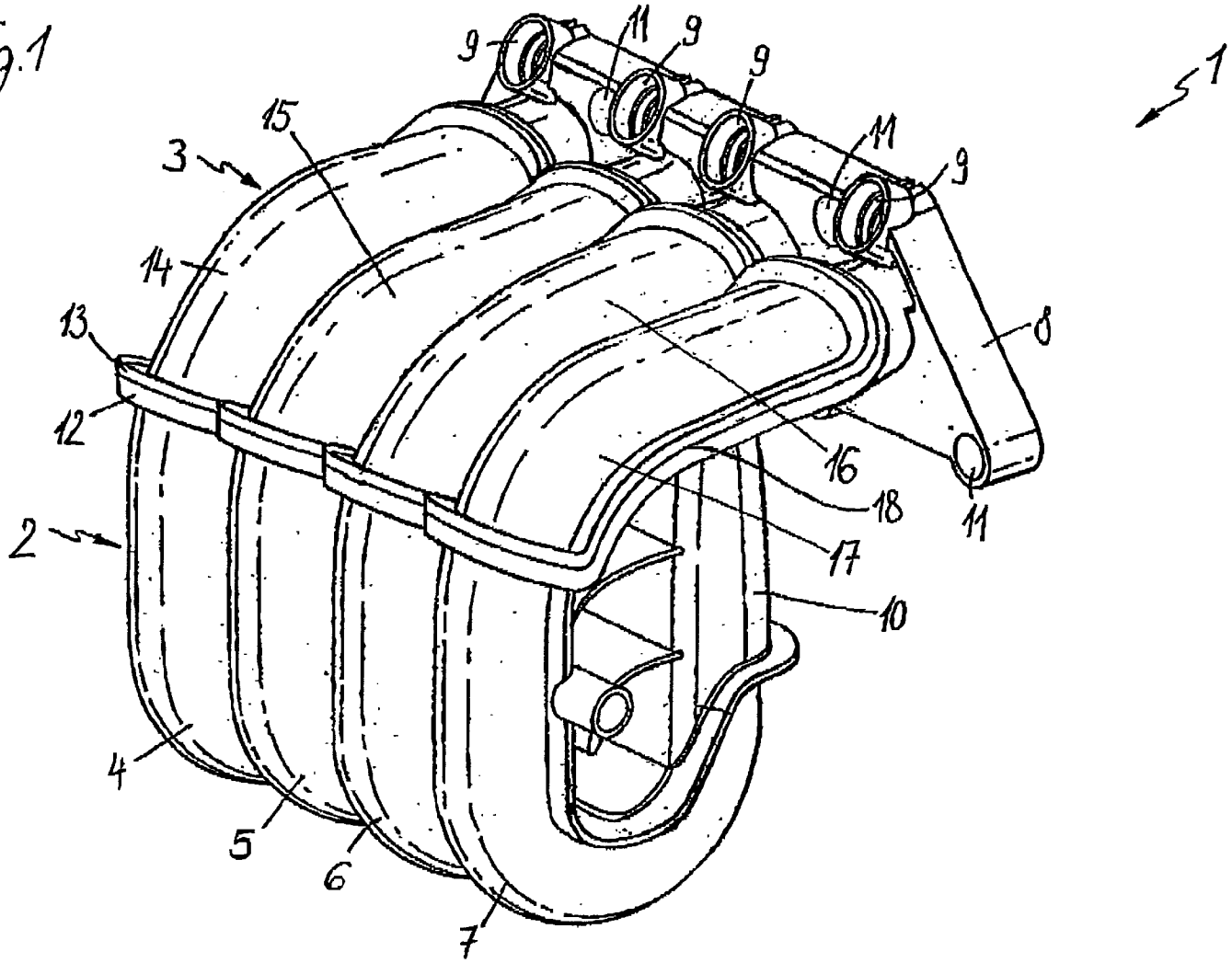
FIG. 1 is a perspective representation of an intake device according to the invention.

FIG. 1 shows an intake device or manifold 1 for an internal combustion engine, which includes four intake pipes 4, 5, 6, 7. Each intake pipe 4, 5, 6, 7 supplies air to one cylinder of the internal combustion engine. For this purpose, the intake pipes 4, 5, 6, 7 are connected to the collecting chamber 10, which is supplied with air through an air filter (not shown). The intake pipes 4, 5, 6, 7 discharge at attachment flange 8, which may be fastened with screws onto the internal combustion engine. Holes 11 for the passage of screws or bolts are provided through attachment flange 8 for this purpose. Recesses 9 for the fuel injectors are positioned on the attachment flange 8 above the intake pipes 4, 5, 6, 7.

The intake pipes 4, 5, 6, 7 are formed by a main body 2 and a cover element 3. The cover element 3 comprises four individual shells 14, 15, 16, 17, which are connected together and which each form a wall section of a respective intake pipe 4, 5, 6, 7. The individual shells are connected to one another via webs, which are preferably elastic, so that the individual shells 14, 15, 16, 17 of the cover element 3 may be adjusted in every direction to match the configuration of the contact surface 18 of the main body. In this way, all tolerances arising during production may be compensated for.

Cover element 3 and main body 2 are preferably produced from synthetic resin material, i.e., a plastic. The same material is advantageously used for both the cover element and for the main body.

To connect main body 2 and cover element 3, along the contact surface 18, a peripheral flange 12 is constructed on main body 2 and a flange 13 is constructed on cover element 3. Flanges 12 and 13 are joined to one another at the contact surface 18, preferably by vibration welding. However, other joining methods, for example gluing, may also be advantageous. The contact surface 18 is laid out in such a way that main body 2 and cover element 3 both have geometries which can be produced easily by injection molding.

Figure 2:
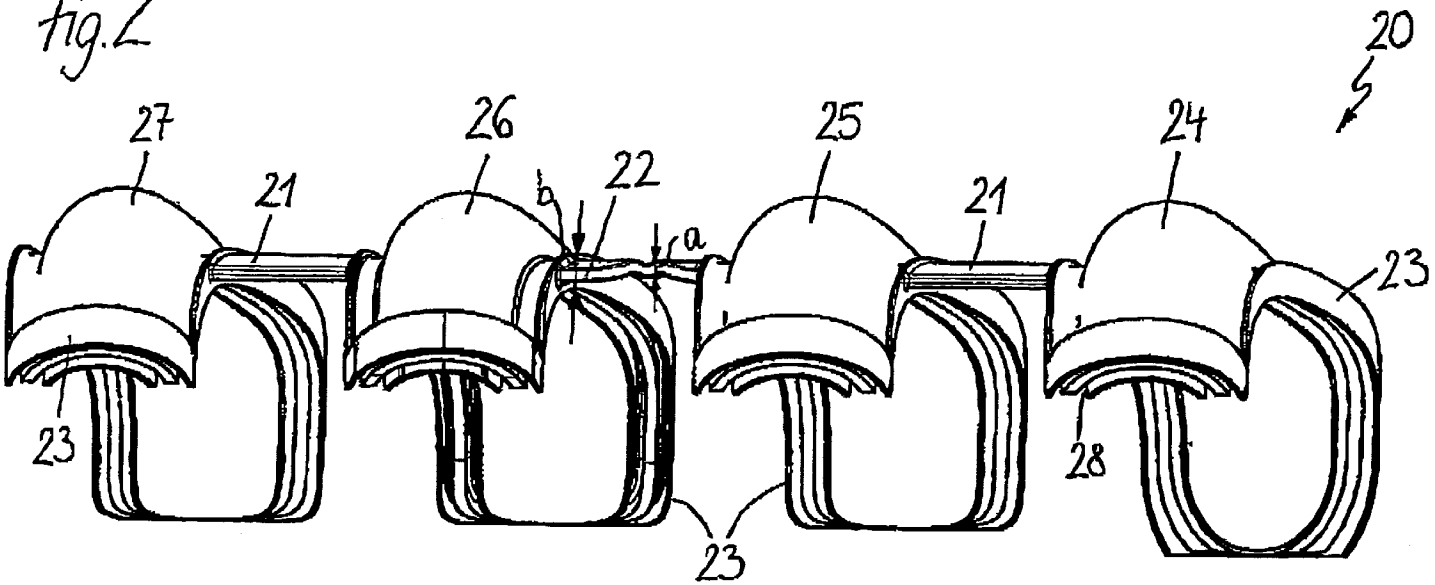
FIG. 2 is a perspective view of a cover element according to the invention.

An embodiment of a cover element 20 is illustrated in FIG. 2. The cover element 20 includes individual shells 24, 25, 26 and 27, which are connected to one another. The flange 23, which is used to join the cover shells to a main body, is provided with lengthwise grooves 28 on the contact surface which contacts the main body. These lengthwise grooves 28 extend next to the actual welding surface and are used as a welding burr accumulator, in which any molten material exiting laterally from the welding surface collects. This is advantageous for producing a burr-free friction-welded joint which is clean toward the intake manifold and the outside.

The outer pairs of individual shells 24, 25 and 26, 27 are each connected substantially non-elastically to one another by a connection web 21. A flexible connection element 22, which is molded onto the flanges 23 of the center pair of individual shells 25 and 26, is arranged between central shells 25 and 26. The thickness a of the connection element 22 is substantially constant, and the thickness b of the flange 23 is greater than the thickness a of the connection element 22.

Figure 3:
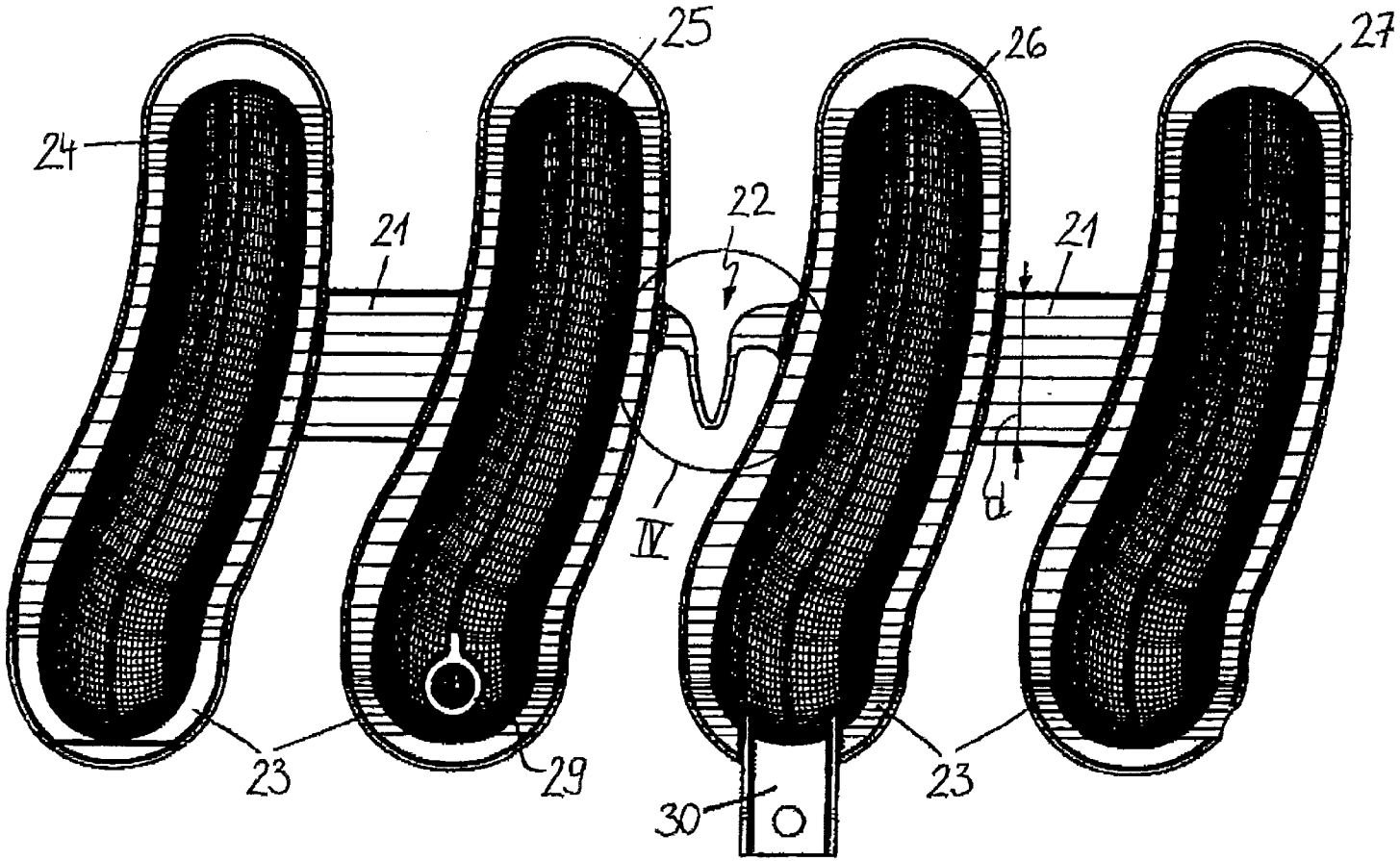
FIG. 3 is a top view of the cover element.

A top plan view of the cover element 20 is shown in FIG. 3. The individual shells 25 and 26 are provided with brackets 29 and 30 for mounting adjacent components. The connection webs 21 between the individual shells 24, 25 and 26, 27 have a wide construction. In particular, the width d of the connection webs 21 is greater than the spacing of the individual shells to be connected. In contrast, the width of the flexible connection element 22 is significantly smaller than the spacing of the individual shells 25, 26.

The connection webs 21 and the flexible connection element 22 connect the oblong individual shells 24, 25, 26, 27 approximately in the middle of their lengthwise extension. However, it may in particular be advantageous to position the flexible connection element 22 at one end of the individual shells. This is particularly desirable if the individual shells are rigidly connected to one another at one end, for example, by a section of a collecting chamber. For large individual shells, it may be advantageous to provide multiple connection webs and flexible connection elements spaced along the length of the individual shells.

The positioning of the flexible connection element and the connection webs may also vary as a function of the necessary tolerance compensation. For example, it may be desirable to position flexible connection elements between the outer individual shells and to connect the middle shells with a substantially rigid (i.e., inelastic) connection web. It may also be advantageous to provide flexible connection elements between all individual shells. Further arrangements may arise in intake devices having a different number of intake pipes, for example, six or eight intake pipes.

Figure 4:
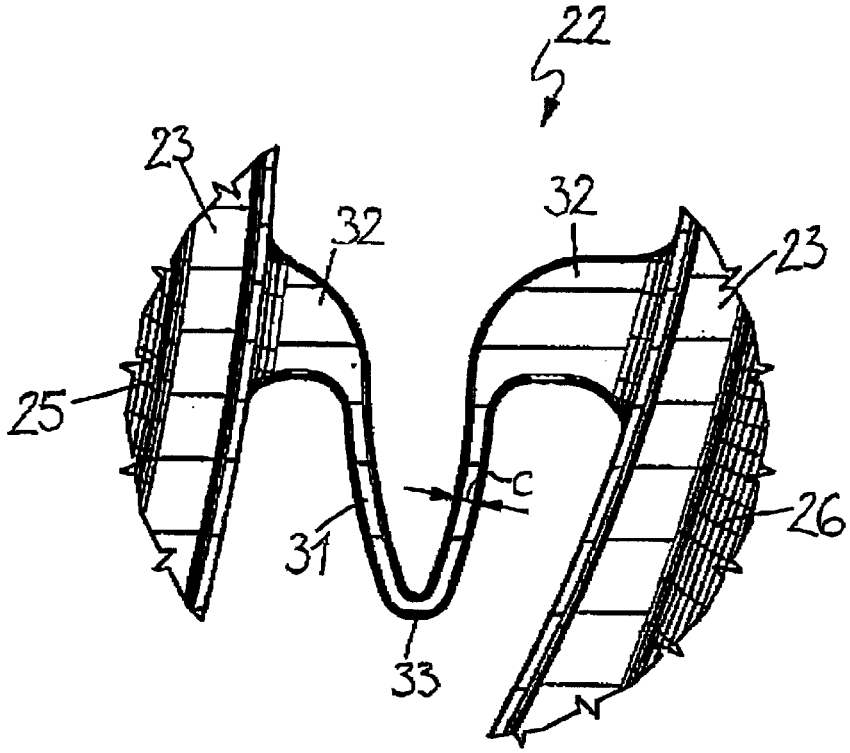
FIG. 4 is an enlarged detail view of detail area IV of FIG. 3.

The connection element 22 of FIG. 3 is illustrated in an enlarged view in FIG. 4. The connection element 22 comprises a flexible section 31, which is constructed with a V-shape and which is positioned approximately centrally between the individual shells 25 and 26. The flexible section 31 has a width c, which is small in comparison to the distance between the individual shells 25 and 26. Due to the small width c of the flexible section 31, the connection element 22 is flexible in all three spatial directions. It is also possible to tilt the individual shells relative to one another.

The tip 33 of the V-shaped section 31 has a rounded construction, which minimizes the danger of breakage at this point. The flexible section 31 is connected to the flanges 23 of the individual shells 25, 26 via connection sections 32. The connection sections 32 are constructed broader in width relative to the flexible section 31, so that a strong connection between the connection element and the individual shells is assured.

Figure 5:
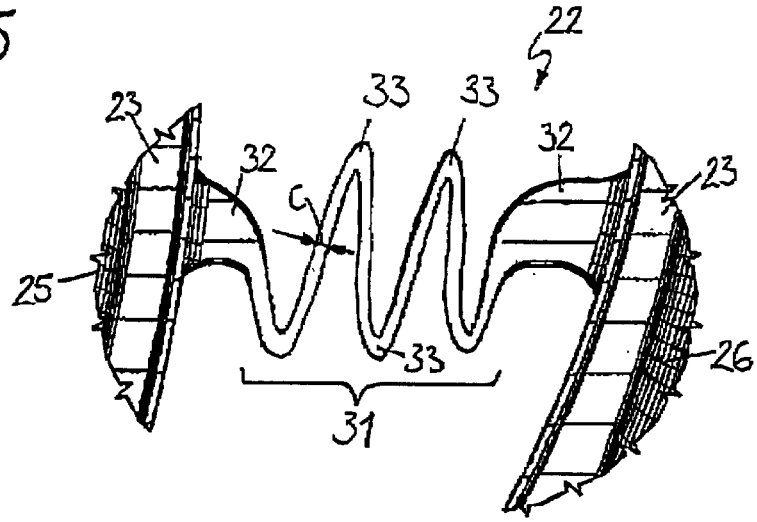
FIGS. 5 to 8 show variant embodiments of the connection element in enlarged views corresponding to FIG. 4.

Another variant embodiment of the flexible section 31 is illustrated in FIG. 5. The flexible section 31 arranged between the connection sections 32 has a zig-zag configuration, each tip 33 having a rounded construction. In the illustrated embodiment, the flexible section 31 has five tips 33, however, flexible sections with a greater or lesser number of bights or tips 33 may be advantageous in some cases.

Figure 6:
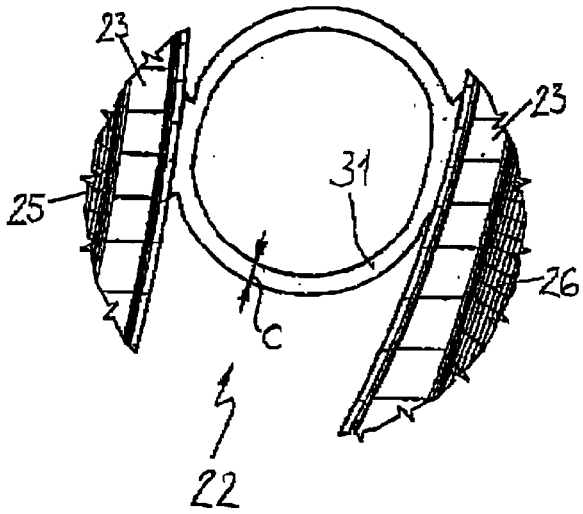

In the illustrative embodiment depicted in FIG. 6, the flexible section 31 has a circular construction. The flexible section 31, having a width c, is connected directly to the flanges 23 of the shells 25, 26.

Figure 7:
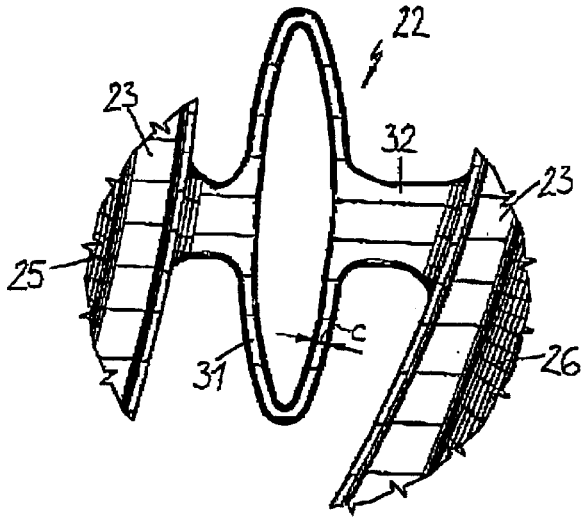

In FIG. 7, an elliptical flexible section 31 is illustrated, which is connected to the flanges 23 via connection sections 32.

Figure 8:
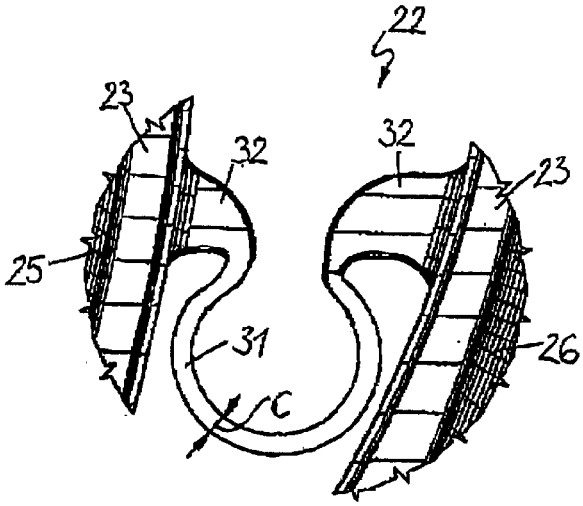

The connection section 32 illustrated in FIG. 8 has a horseshoe or omega-shaped construction. In addition to the variant embodiments shown, other embodiments of the flexible section 31 may also be advantageous.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An intake device for an internal combustion engine, said intake device comprising a main body and a cover element which are securely joined to one another and which form at least two intake pipes, wherein the cover element comprises a plurality of individual shells connected to one another, each individual shell forming a wall section of an intake pipe of the intake device; wherein the connection at least two successively adjacent individual shells is formed by a flexible connection element arranged between them; wherein the flexible connection element comprises a flexible section arranged centrally between two individual shells and flanked by connection sections which connect the flexible section to adjacent individual shells on both sides thereof, said connection sections having a greater width than said centrally arranged flexible section.

2. An intake device according to claim 1, wherein the connection element is flexible in all three spatial directions.

3. An intake device according to claim 1, wherein said flexible section has an approximately constant width over its length.

4. An intake device according to claim 1, wherein the cover element is manufactured in one piece.

5. An intake device according to claim 1, wherein the main body and the cover element are connected to each another by a material bond.

6. An intake device according to claim 5, wherein said material bond is formed by vibration welding.

7. An intake device according to claim 1, wherein the main body and the cover element are connected to each other along contacting peripheral flanges formed on the body and cover element.

8. An intake device according to claim 6, wherein the connection element is substantially co-planar with the flange of the cover element.

9. An intake device according to claim 6, wherein the connection element is fixed on the flange.

10. An intake device according to claim 6, wherein the flange has a thickness which is greater than that of the connection element.

11. An intake device according to claim 1, wherein a flexible connection element is arranged between each two successively adjacent individual shells.

* * * * *